US006928927B2

(12) United States Patent
Endo

(10) Patent No.: US 6,928,927 B2
(45) Date of Patent: Aug. 16, 2005

(54) INTAGLIO PRINTING PRESS

(75) Inventor: Yutaka Endo, Noda (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/671,501

(22) Filed: Sep. 29, 2003

(65) Prior Publication Data

US 2004/0159249 A1 Aug. 19, 2004

(30) Foreign Application Priority Data

Oct. 1, 2002 (JP) ..... 2002-288506

(51) Int. Cl.[7] ..... B41F 9/00
(52) U.S. Cl. ..... 101/153; 101/155
(58) Field of Search ..... 101/155, 154, 101/157, 167, 169, 161, 423, 425, 350.5, 350

(56) References Cited

U.S. PATENT DOCUMENTS

| | | | | |
|---|---|---|---|---|
| 3,316,838 A | | 5/1967 | DesLyons DeFeuchin | 101/152 |
| 4,009,657 A | | 3/1977 | Bonanno et al. | 101/157 |
| 4,119,836 A | | 10/1978 | Motokawa | 219/157 |
| 4,516,496 A | * | 5/1985 | Giori | 101/152 |
| 4,604,951 A | * | 8/1986 | Ichikawa et al. | 101/153 |
| 5,222,432 A | * | 6/1993 | Schaede | 101/157 |
| 5,596,351 A | * | 1/1997 | Stapleton | 346/140.1 |
| 5,749,293 A | | 5/1998 | Ota et al. | 101/157 |
| 5,842,416 A | * | 12/1998 | Olawsky et al. | 101/350.1 |
| 6,024,015 A | * | 2/2000 | Dillig et al. | 101/350.5 |
| 6,561,099 B1 | * | 5/2003 | Jentzsch et al. | 101/484 |

FOREIGN PATENT DOCUMENTS

| | | |
|---|---|---|
| DE | 19717727 A1 | 10/1998 |
| JP | 2-42070 B2 | 9/1990 |

* cited by examiner

*Primary Examiner*—Anthony H. Nguyen
(74) *Attorney, Agent, or Firm*—Birch, Stewart, Kolasch & Birch, LLP

(57) ABSTRACT

An intaglio printing press includes, an intaglio plate cylinder, inking units, each having an ink supplying pattern roller in contact with the intaglio plate cylinder, and each ink supplying pattern roller having different supply patterned portions, an ink removing unit which removes surplus ink of the ink supplied to the intaglio plate cylinder, an ink recycling unit provided upstream of the ink removing unit with respect to a rotation direction of the intaglio plate cylinder and downstream of the inking unit, and adapted to remove ink before the ink is removed by the ink removing unit and return the removed ink to the inking unit. The ink recycling unit includes precedence ink removing means which includes a pre-wiping pattern roller in contact with the intaglio plate cylinder for removing the ink from the intaglio plate cylinder, and ink returning means which returns the removed ink to the inking unit.

18 Claims, 9 Drawing Sheets

INTAGLIO PRINTING PRESS

CROSS REFERENCE TO THE RELATED APPLICATION

The application incorporates by reference the subject matter of Application No. 2002-288506 filed in Japan on Oct. 1, 2002 on which a priority is based under 35 U.S.C 119(a).

BACKGROUND OF THE INVENTION

1. Field of the Invention

The present invention relates to an intaglio printing press having an ink recovery function.

2. Description of Related Art

Intaglio printing is a printing method using a printing plate (intaglio printing plate) having recesses formed in printing image areas with respect to non-printing image areas. After the entire printing plate is filled with ink, the ink on the non-printing image areas is wiped off to leave the ink only in the printing image areas. Thereafter, paper is forced directly to the printing plate under heavy pressure to transfer the ink remaining in the printing image areas onto the paper.

An example of an intaglio printing press used for this type of intaglio printing is shown in FIG. 10. Arrows in the figure indicate rotation directions of cylinders and rollers.

Reference numeral 101 designates an intaglio plate cylinder with which an impression cylinder 102 is in contact. Around the intaglio plate cylinder 101, an intaglio printing plate is mounted. This intaglio printing plate is formed of planes as non-printing image areas and recesses as printing image areas. On one side of the intaglio plate cylinder 101, a plurality of inking units 103 are provided. Pattern rollers 104, which are form rollers of the respective inking units 103, are in contact with the intaglio plate cylinders 101. Ink fountain rollers 106 of ink fountains 105 which reserve inks of different colors are in contact with the respective pattern rollers 104. On the surface of each of the pattern rollers 104, convexly patterned portions are formed such that each color of the ink to be supplied to the corresponding pattern roller 104 is supplied only to areas of the intaglio printing plate where each color of the ink should be supplied. Specifically, each of the ink fountain rollers 106 transfers the ink only to the convexly patterned portions of the corresponding pattern roller 104, and the ink is transferred from the patterned portions to predetermined positions (printing image areas and non-printing image areas) of the intaglio printing plate.

Before a contact point of the intaglio plate cylinder 101 and the impression cylinder 102, a wiping unit 107, as an ink removing unit, is provided on the side of the intaglio plate cylinder 101, and a wiping roller 108 of the wiping unit 107 is in contact with the intaglio plate cylinder 101. The surplus (or excessive) ink on the intaglio printing plate is wiped off by the wiping roller 108. Specifically, the ink remains only in the printing image areas of the intaglio printing plate. The wiping roller 108 is immersed in washing liquid 110 within a washing chamber 109, or the surface thereof is sprayed with the washing liquid. The ink wiped off is washed away by an unillustrated washing unit which is in contact with the wiping roller 108 in the washing liquid 110.

Meanwhile, a sheet of paper 111 is fed between the intaglio plate cylinder 101 and the impression cylinder 102. The sheet of paper 111 is pressed against the intaglio printing plate of the intaglio plate cylinder 101 under strong pressure by the impression cylinder 102, and the ink in the printing image areas of the intaglio printing plate is transferred onto the sheet of paper 111. The printed paper after this intaglio printing is delivered by a delivery unit 112.

As described above, the surplus ink of the ink supplied to the intaglio printing plate is wiped off by the wiping roller 108. However, the surplus ink is not always wiped off completely only by the wiping roller 108. Therefore, as disclosed in the Japanese Patent Laid-Open No. Heisei 2-42070, a pre-wiping roller is provided upstream of the wiping roller 108 and may wipe off the surplus ink before the wiping roller 108 does so.

Since quite a large quantity of the ink is wiped off by the wiping roller 108, recovery of such ink has been demanded. Particularly, recovery of a color of ink which is used in a large quantity and of an expensive ink has been demanded.

However, when the wiping roller 108 is immersed in the washing liquid to remove the ink, the ink is mixed into the washing liquid. Therefore, the ink is no longer seperatable and recoverable, and thus it has been discarded. The Japanese Patent Laid-Open No. Heisei 2-42070 suggests carrying out the pre-wiping only, and it is thus considered that the pre-wiped ink has also been discarded.

Thereupon, recovery of the ink has been conducted before the wiping roller 108 wipes off the ink. Currently, the recovery of the ink is carried out by an operator using a spatula or the like to return the ink, which is transferred from the surface of the intaglio printing plate to the surface of the roller, into the ink fountain.

However, since the recovery of the ink is manually operated by the operator using the spatula, the operator sometimes drops the scraped ink or returns the ink into an ink fountain for a different color of ink after collecting the ink in a saucer. When the recovered ink is returned into an ink fountain for a different color of ink, a large quantity of spoilage of paper occurs.

SUMMARY OF THE INVENTION

The present invention was accomplished in light of the foregoing technical circumstances, and an object of the present invention is to enable surplus ink on an intaglio printing plate to be automatically recovered, realizing ink recycling with no waste without inconvenience of an operator.

A configuration of the present invention for addressing the foregoing problems concerns an intaglio printing press includes:

an intaglio plate cylinder supported to be freely rotatable;

at least one inking unit for supplying ink to the intaglio plate cylinder;

an ink removing unit which removes surplus ink of the ink supplied to the intaglio plate cylinder; and an ink recycling unit provided upstream of the ink removing unit with respect to a rotation direction of the intaglio plate cylinder and downstream of the inking unit, and adapted to remove the ink before the ink is removed by the ink removal unit and return the removed ink to the inking unit.

In the intaglio printing press according to the present invention, ink is supplied to the intaglio plate cylinder by the inking unit, and the surplus ink supplied to the intaglio plate cylinder is recovered by the ink recycling unit and then returned to the inking unit. The intaglio plate cylinder is usually wrapped with the intaglio printing plate which includes printing image areas and flat non-printing image areas, in which the printing image areas are engraved with respect to the non-printing image areas. The ink is supplied onto this intaglio printing plate.

With the intaglio printing press according to the present invention, recovery and recycling of ink can be carried out without bothering an operator. Since an amount of consumed ink decreases, a reduction in printing costs can be achieved. Further, since an amount of discarded ink decreases, works and costs required for discarding ink can be saved, which is environmentally advantageous. Furthermore, since an amount of ink removed by an original ink removing unit decreases, an amount of ink to be washed away by washing liquid is reduced. Therefore, the washing liquid to be consumed is reduced, realizing cost reduction, and the washing liquid to be discarded is reduced, which is environmentally advantageous.

The ink recycling unit may include, for example, precedence ink removing means which removes ink from the intaglio plate cylinder, and ink returning means which returns the ink removed by the precedence ink removing means.

In the intaglio printing press in the above case, the surplus ink on the intaglio plate cylinder is removed (recovered) by transferring the ink using the precedence ink removing means of the ink recycling unit to a roller which is in contact with the intaglio printing plate, prior to removal thereof by the ink removing unit. The recovered ink is returned to the inking unit by the ink returning means or the like and supplied to the intaglio plate cylinder again.

The ink returning means may include, for example, at least one pipe connected between the precedence ink removal means and the inking unit, and a pump which supplies ink to the inking unit through the pipe.

Moreover, the present invention may further include ink amount detecting means which detects an amount of ink stored in the inking unit to control drive of the pump in accordance with a detected result by the ink amount detecting means.

Employed for the ink amount detecting means may be, for example, an ultrasonic sensor which detects an amount of ink within an ink fountain of the inking unit. The ink returning means may be controlled, for example, to supply ink into the ink fountain once the amount of ink in the ink fountain becomes a certain amount after being consumed, and stop supplying ink once the ink in the ink fountain is increased to a certain amount.

The inking unit may include, for example, an ink supplying pattern roller which is in contact with the intaglio plate cylinder.

The ink supplying pattern roller may include a convexly patterned regions which corresponds to areas in the intaglio plate cylinder, where ink should be supplied. Specifically, in the case where the inking unit supplies plural kinds of ink, each kind of the ink is supplied to the areas in the intaglio plate cylinder, in which each kind of the ink should be supplied.

The precedence ink removing means may include, for example, a pre-wiping pattern roller which is in contact with the intaglio plate cylinder, an ink transfer roller which transfers the ink on the pre-wiping pattern roller, and ink scraping means which scrapes ink on the ink transfer roller.

In the intaglio printing press of this kind, the surplus ink on the intaglio plate cylinder is transferred to the pre-wiping pattern roller, and transferred from the pre-wiping pattern roller onto the ink transfer roller. Thereafter, the ink is scraped from the ink transfer roller by the ink scraping means.

The precedence ink removing means may include, for example, an ink doctor roller which transfers the ink on the intaglio plate cylinder, an ink scraping blade which is in contact with the circumferential surface of the ink doctor roller, and a recovery blade which recovers the scraped ink on the ink scraping blade.

In the intaglio printing press of this kind, the surplus ink on the intaglio plate cylinder is transferred to the ink doctor roller, and the ink on the ink scraping blade, scraped from the ink doctor roller by the ink scraping blade, is recovered by the recovery blade.

The precedence ink removing unit may include, for example;

a pre-wiping pattern roller, which is in contact with the intaglio plate cylinder and having convexly patterned regions corresponding to areas on the intaglio plate cylinder, where desired ink is applied, so as to transfer the desired ink;

an ink transfer roller which is in contact with the pre-wiping pattern roller and adapted to transfer the ink transferred to the convexly patterned regions of the pre-wiping pattern roller;

an ink scraping blade which scrapes the ink on the ink transfer roller; and a recovery blade which recovers the ink on the ink scraping blade, scraped by the ink scraping blade, into an ink recovery box.

In the intaglio printing press of this kind, the surplus ink on the intaglio plate cylinder is transferred to the pre-wiping pattern roller, since the pre-wiping pattern roller is in contact with the intaglio plate cylinder. The ink is then transferred from the pre-wiping pattern roller onto the ink transfer roller. Thereafter, the ink is scraped from the ink transfer roller by the ink scraping blade and then put on the ink scraping blade. The ink on the ink scraping blade is recovered into the recovery box by the ink recovery blade. The ink recovered in the ink recovery box is returned to the inking unit by the ink returning unit. The ink returning unit includes, for example, a pump provided in the ink recovery box, and at least one pipe extending from the pump to the inking unit. Ink is sent from the ink recovery box to the inking unit by drive of the pump.

Further, in the present invention, heating means such as a heating plate (heater) may be provided in the ink scraping blade and the ink recovery box, in order not to change viscosity of the recovered ink.

Furthermore, in the present invention, an external discharge pipe for discharging the recovered ink to outside may be provided as necessary.

BRIEF DESCRIPTION OF THE DRAWINGS

The present invention will become more fully understand from the detailed description given herein below and the accompanying drawings which are given by way of illustrations only, and thus are not limitation of the present invention, and wherein.

DETAILED DESCRIPTION OF THE INVENTION

Next, embodiments of the intaglio printing press according to the present invention will be described.

First of all, the entire configuration of the intaglio printing press will be described.

Figure 4:
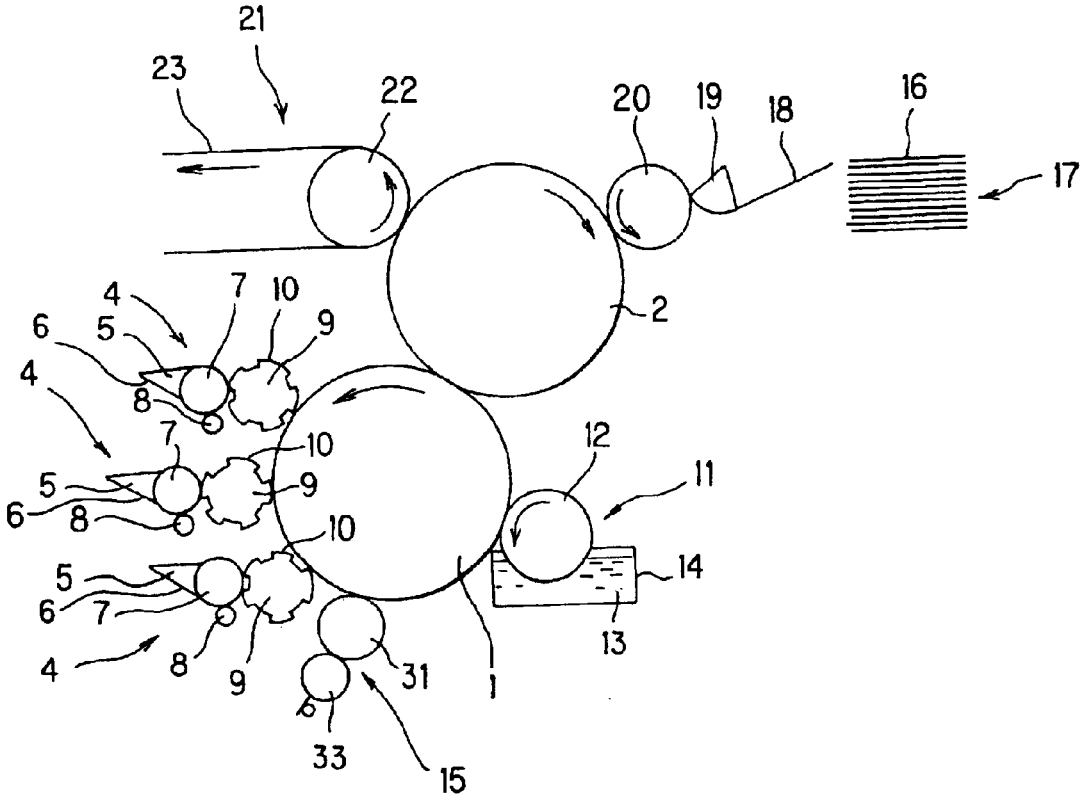
FIG. 4 is a schematic side view of the entire intaglio printing press according to the embodiment.
Figure 5:
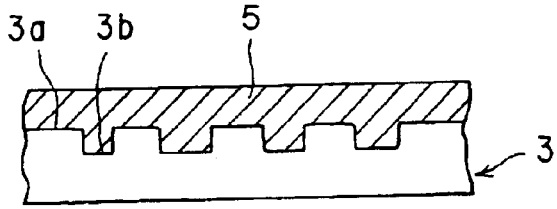
FIG. 5 is a cross-sectional view of a part of an intaglio printing plate.

In FIG. 4, reference numeral 1 denotes an intaglio plate cylinder, with which an impression cylinder 2 is in contact. Around the intaglio plate cylinder 1, an intaglio printing plate 3 is mounted. As shown in FIG. 5, the intaglio printing plate 3 is formed by flat non-printing image areas 3*a* and printing image areas 3*b* (portions to become an image) formed to be recessed with respect to the non-printing image areas 3*a*. When printing a printed matter having a plurality of colors, predetermined color of ink should be supplied to corresponding areas of the intaglio printing plate 3. In order to do so, an inking unit, which supplies ink to the intaglio printing plate 3, provides the ink of the predetermined color to the predetermined areas.

In this embodiment, a printed matter is printed using three colors of ink, and three inking units 4 are provided on one side of the intaglio plate cylinder 1, these inking units are referred to as a first, second, and third inking units 4*a*, 4*b*, and 4*c*, respectively, when seen along a rotation direction of the intaglio plate cylinder 1, as necessary. Each of the inking units 4 includes an ink fountain 6 in which ink 5 is stored, an ink fountain roller 7, a part of which is in contact with the ink 5 in the ink fountain 6, a swing roller 8 which is swung in an axial direction in order to allow even distribution of the ink on the ink fountain roller 7, and an ink supplying pattern roller (form roller) 9 (9*a*, 9*b*, and 9*c*) which is in contact with the ink fountain roller 7 as well as the intaglio plate cylinder 1 (intaglio printing plate).

Figure 6A:
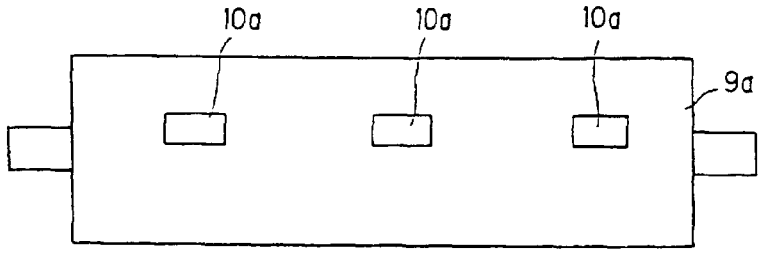
FIGS. 6A to 6D are schematic views of an ink pattern roller and a pre-wiping roller.
Figure 6B:
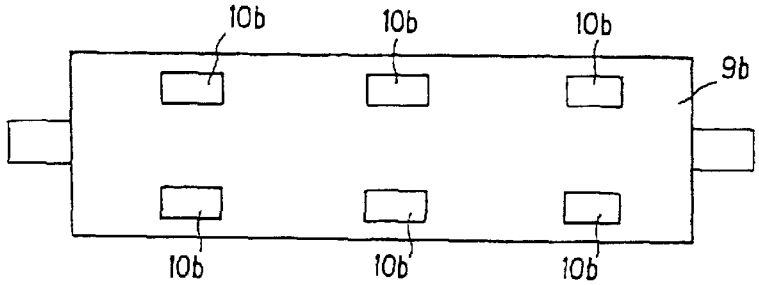
Figure 6C:
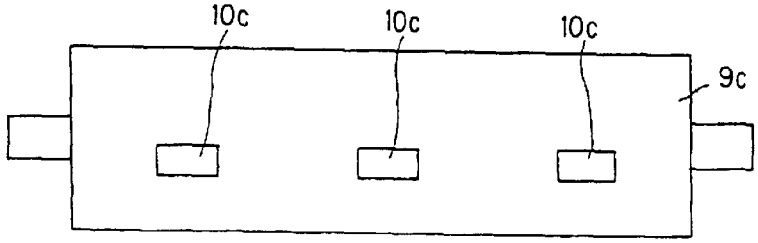

On the surfaces of each of the ink supplying pattern rollers 9*a* to 9*c*, convex supplying patterned portions (patterned areas) 10 (10*a*, 10*b*, and 10*c*) are formed so that the ink, which is supplied by each of the pattern rollers 9*a* to 9*c*, is supplied to areas in the intaglio printing plate where each color of ink should be supplied, that is, each of the pattern rollers 9*a* to 9*c* contacts with only these areas as shown in FIGS. 6A, 6B, and 6C. Accordingly, the ink 5 in the ink fountain 6 is discharged by the ink fountain roller 7, and transferred to the supplying patterned portions 10 of the pattern roller 9 after evenly distributed by the swing roller 8. The ink 5 is then supplied from the supplying patterned portion 10 to the areas (non-printing image areas and printing image areas) of the intaglio printing plate, where the ink 5 should be supplied.

A wiping unit 11, as an ink removing unit, is provided at a position upstream of the position where the intaglio plate cylinder 1 and the impression cylinder 2 contact, in a rotating direction. The wiping unit 11 includes a wiping roller 12 which is in contact with the intaglio plate cylinder 1, and a washing chamber 14 which stores washing liquid 13 in which the wiping roller 12 is immersed. The wiping roller 12 rotates in an opposite direction to the intaglio plate cylinder 1, in other words, rotates as if rubbing itself against the intaglio plate cylinder 1, and operates to wipe off the surplus ink on the non-printing image areas 3*a* of the intaglio printing plate 3 of the intaglio plate cylinder 1.

An ink recycling unit 15 is provided upstream of the wiping unit 11 with respect to a rotation direction of the intaglio plate cylinder 1 and downstream of the pattern roller 9*c* of the third inking unit 4*c*. The ink recycling unit 15 is for removing the surplus ink on the intaglio printing plate before the ink is wiped off by the wiping unit 11. The details of the recycling unit 15 will be described later.

Meanwhile, sheets of paper 16 to be provided for printing are stacked in a feeding unit 17, and are sent out onto a feedboard 18 one at a time. A swing unit 19 is placed in the feedboard 18, and subsequently, an intermediate cylinder 20 is provided. The intermediate cylinder 20 has a gripper which grips the sheets of paper 16, and is in contact with the impression cylinder 2. The gripper which grips the sheets of paper 16 is also provided in the impression cylinder 2.

A delivery unit 21 is provided on the side of the impression cylinder 2, and downstream of the contact point of the impression cylinder 2 and the intaglio plate cylinder 1 in a rotation direction. The delivery unit 21 has a delivery cylinder 22 which is in contact with the impression cylinder 2, and a pair of delivery chains 23 which is stretched between unillustrated sprockets that are coaxial with the delivery cylinder 22. In the delivery chains 23, unillustrated delivery grippers are provided, which re-grips the sheets of paper 16 from the gripper of the impression cylinder 2.

Outline of printing operation of the above intaglio printing press will be described.

The sheets of paper 16 are sent out from the feeding unit 17 onto the feedboard 18 one sheet at time, passed to the intermediate cylinder 20 by the swing unit 19, and then gripped by the gripper of the intermediate cylinder 20. The sheet of paper 16 gripped by the intermediate cylinder 20 is re-gripped by the impression cylinder 2. The sheet of paper 16 enters through the contact point where it comes into contact with the intaglio plate cylinder 1, while being wrapped on the circumferential surface of the impression cylinder 2.

The ink 5 in the ink fountain 6 of each of the inking units 4 is supplied to the intaglio plate cylinder 1 through the fountain roller 7 and the pattern roller 9. The surplus ink on the intaglio plate cylinder 1 is removed by the ink recycling unit 15. Subsequently, the wiping roller 12 of the wiping unit 11 wipes off the ink on the intaglio plate cylinder 1. By this wiping, the ink 5 on the non-printing image areas 3*a* of the intaglio printing plate 3 is removed, and the ink 5 remains only in the printing image areas 3*b*.

The sheet of paper 16 is fed to the contact point of the intaglio printing plate 3 and the impression cylinder 2 in the above state. The sheet of paper 16 is pressed against the intaglio printing plate 3 by the impression cylinder 2 under strong pressure, and the ink in the printing image areas 3*b* is transferred onto the sheet of paper 16, and thus printing is carried out. The printed sheet of paper 16 is re-gripped by the delivery cylinder 22 of the delivery unit 21, and further re-gripped by the delivery grippers of the delivery chains 23 to be delivered.

Next, details of the ink recycling unit 15 will be described.

Figure 6D:
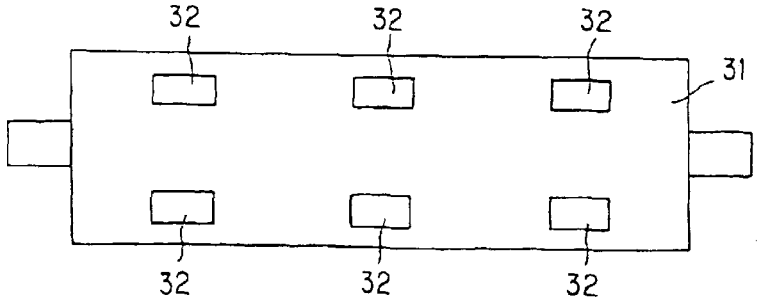

The ink recycling unit 15 has a pre-wiping pattern roller (hereinafter, referred to as a pre-wiping roller) 31 which is in contact with the intaglio plate cylinder 1. On the surface of the pre-wiping roller 31, the recovery patterned portions (patterned areas) 32 are formed in order to recover desired ink. The recovery patterned portions 32 correspond to areas in the intaglio printing plate where the desired ink is applied. When there are three inking units 4, three kinds of ink are supplied to the intaglio printing plate. However, in the case of wanting to mainly recover one kind of ink among the three, the recovery patterned portions 32 are formed so as to correspond to the areas where the ink to be recovered is applied. In this example, the ink supplied by the ink supplying pattern roller 9*b* is recovered. Therefore, as shown in FIGS. 6B and 6D, the recovery patterned portions 32 on the pre-wiping roller 31 are arranged identically to the patterns 10*b* of the ink supplying patterned roller 9*b*. The pre-wiping roller 31 is not for wiping off the ink as the subsequent wiping unit 11 does, but for transferring the ink on the intaglio printing plate. Therefore, a rotation direction at the contact point is the same as that of the intaglio plate cylinder 1.

An ink transfer roller 33 as a transfer roller is in contact with the pre-wiping roller 31. The ink transferred to the recovery patterned portions 32 of the pre-wiping roller 31 is transferred to the ink transfer roller 33.

With the ink transfer roller 33, the top end of a scraping blade (doctor blade) 34, as ink scraping means, is in contact, while orientating its length to an approximate axial direction of the ink transfer roller 33. A support member 36 is provided to an axis 35 that is parallel to the ink transfer roller 33. To this support member 36, the scraping blade 34 is attached. The axis 35 is supported by a frame 38 of an inking apparatus 37 in which the inking units 4 are built. The scraping blade 34 carries therein a heating plate 39 as heating means. By heating the scraping blade 34 using the heating plate 39 in advance, reduced viscosity of the recovered ink on the scraping blade 34 is prevented.

As seen from the foregoing, in this embodiment, the ink transfer roller 33 corresponds to an ink transfer roller, and the pre-wiping roller 31 and the ink transfer roller 33 correspond to an ink doctor roller.

Figure 1:
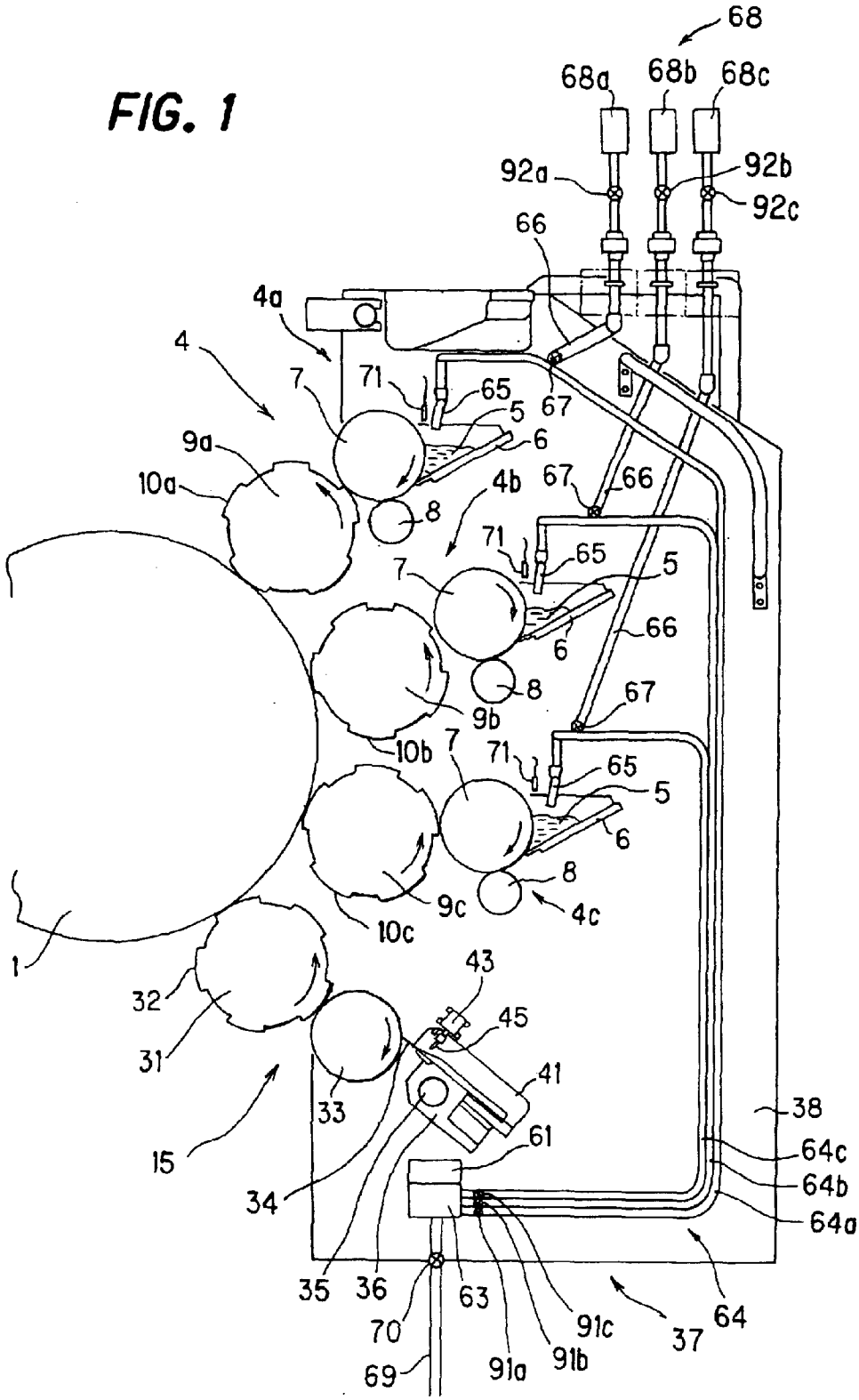
FIG. 1 is a schematic side view of an ink recycling unit in an intaglio printing press according to an embodiment of the present invention.
Figure 2:
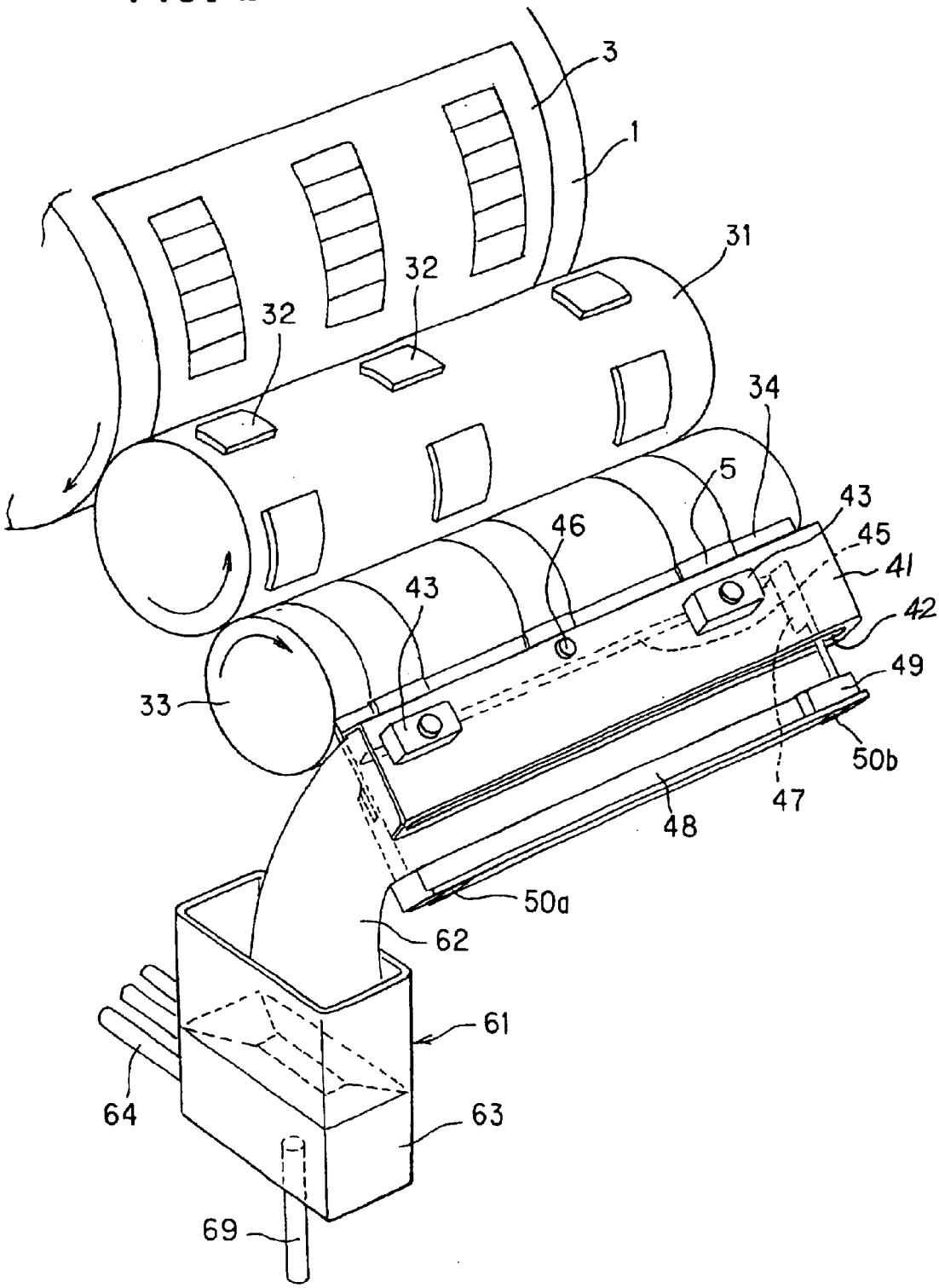
FIG. 2 is a schematic perspective view of the ink recycling unit depicted in FIG. 1.
Figure 3:
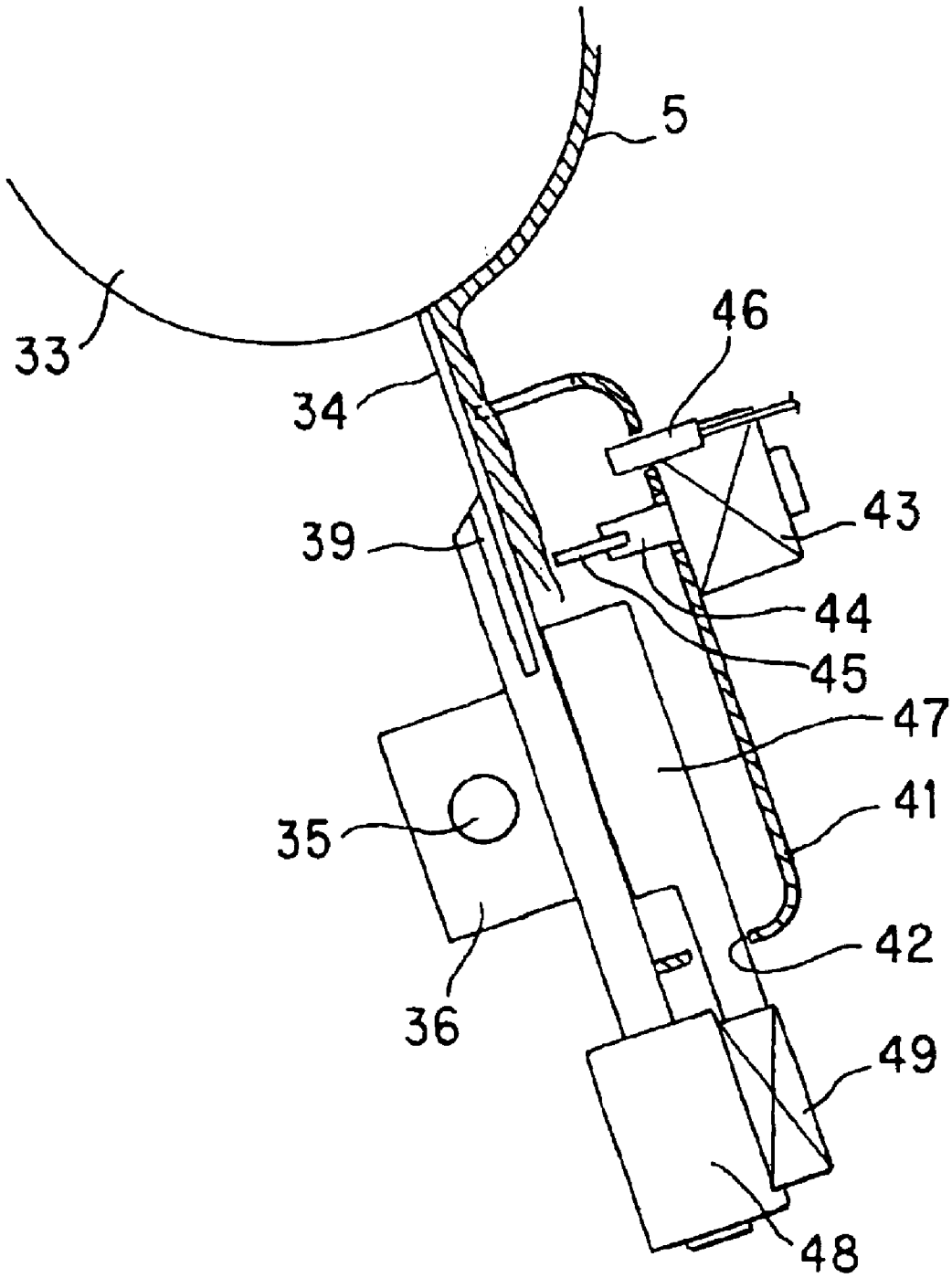
FIG. 3 is a cross-sectional view of FIG. 2.

On the scraping blade 34, as shown in FIGS. 1–3, a channel-shaped holder 41 is provided while facing downward. The front portion of the holder 41 (the surface facing the ink transfer roller 33) is opened, and attached to the scraping blade 34 only at the bilateral ends thereof. The rear portion of the holder 41 is attached to the scraping blade 34 across the entire width thereof, and provided with a long hole 42 across the almost entire width thereof.

A bilateral pair of air cylinders 43 is provided at positions near the front portion on the top surface of the holder 41. Drive axes 44 of the air cylinders 43, extending within the holder 41, holds an ink cutter 45. The ink cutter 45 has a length approximately the same as the width of the scraping blade 34. By driving the air cylinders 43, the ink cutter 45 is reciprocatingly moved vertically to the surface of the scraping blade 34.

A recovered ink detecting unit 46 for detecting the presence of the ink is provided at a position slightly before the ink cutter 45 (on an upstream side of the ink cutter 45 in an ink flow direction) in the holder 41. This recovered ink detecting unit 46 detects the ink incoming into the holder 41.

Within the holder 41, a recovery blade 47 is provided to be able to move along the surface of the scraping blade 34, and the rear portion thereof extends from the long hole 42 to the rear portion of the scraping blade 34. A rodless cylinder (air cylinder) 48 is provided at the rear end portion of the scraping blade 34, and a reciprocatingly movable mover 49 thereof holds the rear end portion of the recovery blade 47. Therefore, by driving the rodless cylinder 48, the recovery blade 47 is moved together with the mover 49 in a width direction (longitudinal direction) along the surface of the scraping blade 34. In the rodless cylinder 48, two positioning sensors 50*a* and 50*b* are provided for determining a range of the movement. The positions of these positioning sensors 50*a* and 50*b* determine the movement range of the recovery blade 47. The movement range of the recovery blade 47 is changed by changing the positions of the positioning sensors 50*a* and 50*b*.

An ink recovery box 61 is provided under one side of the support member 36. A guide plate 62 which guides the ink is provided from the scraping blade 34 through the ink recovery box 61. A heating plate (not shown) is wrapped round the ink recovery box 61, preventing the reduced viscosity of the recovered ink. There is a discharge port at the bottom of the ink recovery box 61, and a pump 63 is provided further down the port. To the pump 63, an ink recycling pipe 64 is connected. In this embodiment, three ink recycling pipes 64 are connected. Each of the ink recycling pipes 64 extends to each of the inking units 4, and nozzles 65 at the tips of the respective ink recycling pipes 64 face the tops of the respective ink fountains 6.

In this embodiment, since one kind of ink is recovered, one of the ink recycling pipes 64 (64*a*, 64*b*, or 64*c*) is used. At this time, the unused ink recycling pipes 64 are closed by switch valves 91 (91*a*, 91*b*, or 91*c*). The inking unit 4 which supplies the ink to be recovered can be different depending on printing. Therefore, the inking units 4*a* to 4*c* have the recycling pipes 64*a* to 64*c*, respectively, such that the ink is returned to all of the inking units 4*a* to 4*c*, The inking apparatus 37 is equipped with three originally-provided new ink supply pipes 66 for supplying the ink to each of the inking units 4. The new ink supply pipes 66 are respectively connected to the corresponding ink recycling pipes 64, through the switch valves 67. The new ink supply pipes 66 are connected to ink supply units 68*a*, 68*b*, and 68*c*, respectively, through pumps 92*a*, 92*b* and 92*c*.

An external discharging pipe 69 having a switch valve 70 is connected to the ink recovery box 61, and thus the ink can be discharged outside as required.

In this embodiment, when recycling the ink, the switch valve 91*b* for the inking unit 4*b* is opened and the switch valves 91*a* and 91*c* for the inking units 4*a* and 4*c* are closed. By so doing, only the ink wanted to be recycled can be returned to the inking unit 4*b*, and additionally, there is an advantage that the pipes 64*a* and 64*c* of the other inking units 4*a* and 4*c* are kept clean. All of the switch valves 91*a* to 91*c* are closed when discharging the ink to the external discharging pipe 69.

At the top of each of the ink fountains 6, an ink level sensor 71, as an ink amount detecting means, is provided. The ink level sensor 71 detects that the amount of the ink within the ink fountain 6 has become a certain amount or less and that the ink has reached a certain amount or more. For this sensor 71, for example, an ultrasonic sensor is used. The ink to be supplied into the ink fountain 6 is controlled in response to the sensed result of the sensor 71.

Figure 7:
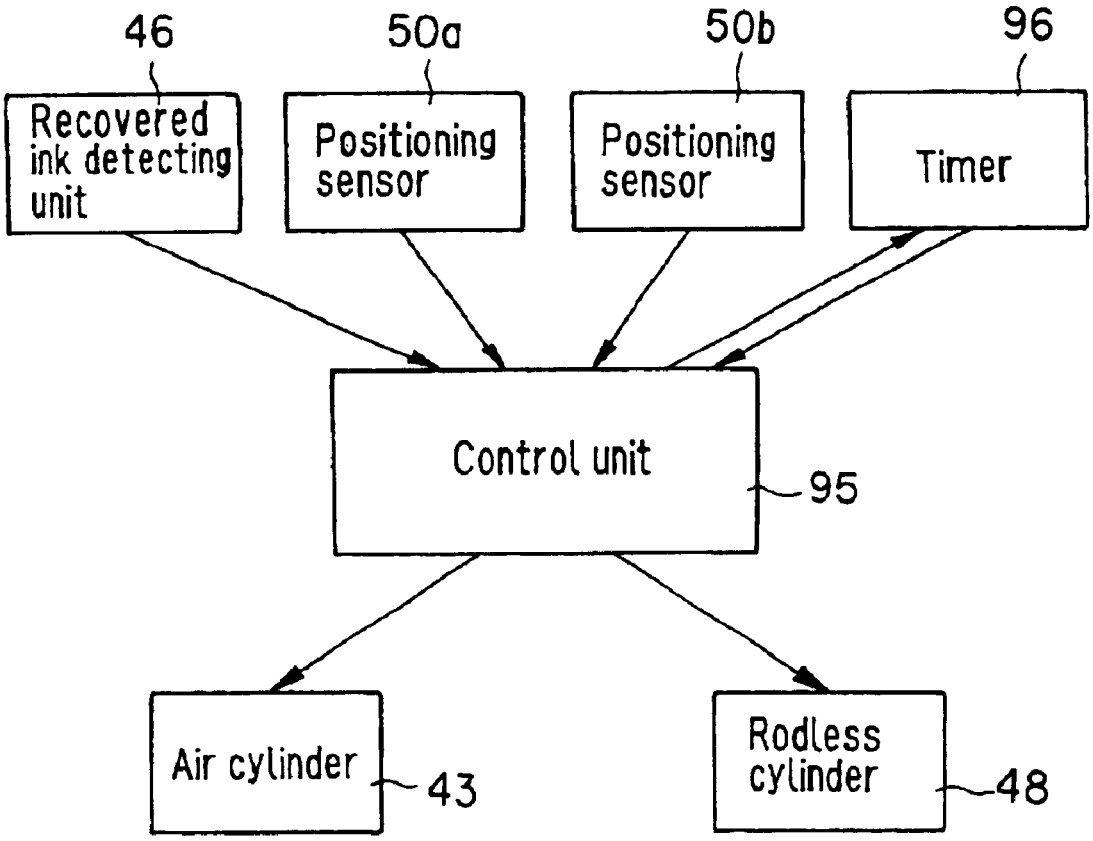
FIG. 7 is a block diagram of a control unit of an ink recovery unit.

Next, operations of the ink recycling unit will be described. FIG. 7 shows a control block diagram of the ink recycling unit 15 in the intaglio printing press. The sensed results from the recovered ink detecting unit 46 and the positioning sensors 50*a* and 50*b* are inputted to a control unit 95 control means. Further, the control unit 95 sends drive instructions to the air cylinders 43 and the rodless cylinder 48. A timer 96 is provided for setting the timing to drive the air cylinders 43 and the rodless cylinder 48.

Surplus ink on the intaglio printing plate is transferred to the recovery patterned portions 32 of the pre-wiping roller 31, which is in contact with the intaglio plate cylinder 1. Since the ink transfer roller 33 is in contact with the pre-wiping roller 31, the ink on the recovery patterned portions 32 of the pre-wiping roller 31 is transferred to the ink transfer roller 33. Since the top end of the scraping blade 34 is in contact with the ink transfer roller 33, the ink on the ink transfer roller 33 is scraped by the scraping blade 34. The ink scraped by the scraping blade 34 zonally flows on the scraping blade 34 and enters the holder 41. Since the rear portion of the holder 41 is attached to the scraping blade 34, the ink entered the holder 41 is prevented from flowing to the rodless cylinder 48.

Once the recovered ink detecting unit 46 detects the ink entering the holder 41, the bilateral pair of air cylinders 43 is driven after a certain period of time which is set by the timer 96 and begins at the time point of the detection, and the ink cutter 45 is moved vertically to the surface of the scraping blade 34 (block position). Thereafter, the rodless cylinder 48 is driven, and the recovery blade 47 is moved from the right end (standby position) to the left end (discharge position) shown in FIG. 2. By the movement of the recovery blade 47, the ink on the scraping blade 34 is scraped and discharged as if it is pushed out from an end of the holder 41. The ink is then recovered in the recovery box 61 flowing along the guide plate 62. The recovery blade 47 returns to the original position (standby position) as the rodless cylinder 48 is driven in the reverse direction, and the ink cutter 45 also returns to the original position (standby position) as the air cylinders 43 are driven in the reverse direction, thus going to standby in preparation for the next ink recovery. The subsequent ink is blocked by the ink cutter 45. Therefore, even when the recovery blade 47 is moved in the reverse direction (direction to return to the original position) after the ink recovery, the ink will not be recovered in this direction.

The recovery blade 47 is controlled to repeatedly operate at a regular interval during the operation of the printing press. Specifically, operation instructions are given to the air cylinders 43 at every predetermined time set by the timer 96. By the air cylinders 43 being driven, the ink cutter 45 descends to block the ink. In this state, an operation instruction is given to the rodless cylinder 48. By the rodless cylinder 48 being driven, the recovery blade 47 moves from the standby position to the discharge position, and the ink is discharged. These operations are repeatedly carried out.

By the pump 63 being driven, the ink recovered in the ink recovery box 61 is supplied into the ink fountain 6 of the inking unit 4*b* through the switch valve 91*b* and the ink recycling pipe 64*b*. In this way, the surplus ink of the ink supplied on the intaglio printing plate is soon recovered and returned to the inking unit 4 in a relatively short period of time. As for the other inking units 4 for supplying the ink, in which the ink is not recovered, new ink is supplied thereto by the ink supply unit 68, in accordance with the amount of the consumed ink.

Figure 8:
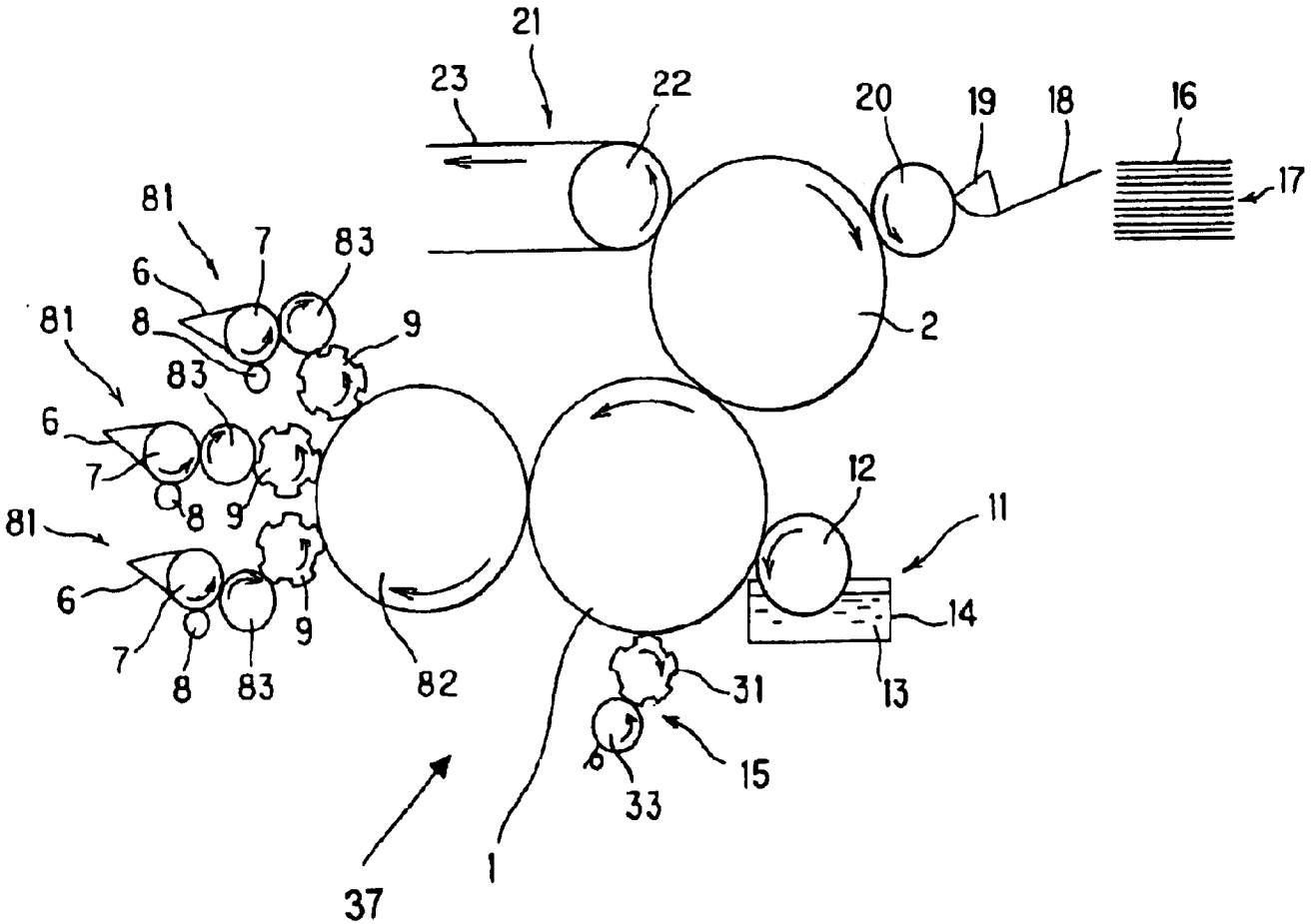
FIG. 8 is a schematic side view of an intaglio printing press according to another embodiment of the present invention.

FIG. 8 shows an intaglio printing press according to another embodiment of the present invention. In this embodiment, ink is not directly supplied to an intaglio plate cylinder 1 by an inking unit 81. Instead, all of the ink is collected onto a collecting cylinder 82, which is a rubber blanket cylinder, and transferred to an intaglio printing plate of the intaglio plate cylinder 1. A pattern roller 9, serving as a form roller of each of the inking units 81, is in contact with the collecting cylinder 82. The inking units 81 are different from those depicted in FIGS. 1 and 4, that is, the ink is not directly supplied to the pattern roller 9 by the fountain roller 7, but a distributing roller (rubber roller) 83 is provided therebetween. An ink recycling unit 15 is provided between a wiping unit 11 and a contact point of the collecting cylinder 82 and the intaglio plate cylinder 1. The rest of the configuration is the same as the preceding embodiment, and the same members are denoted with the same referential numerals in FIG. 8. Note that, in this embodiment, the inking unit 81 and a scraping roller 33 of the ink recycling unit 15 are also built to an inking apparatus 37.

In this intaglio printing press, the ink from the inking unit 81 is transferred onto the collecting cylinder 82 through the pattern roller 9. As understood from the arrangement, the ink is sequentially transferred onto the collecting cylinder 82 by the inking units 81, starting from the bottom one. The collecting cylinder 82 and the intaglio plate cylinder 1 contact each other, and thereby the ink on the collecting cylinder 82 is transferred onto the intaglio printing plate of the intaglio plate cylinder 1. The surplus ink on the intaglio printing plate is recovered by the ink recycling unit 15 before the wiping unit 11. Contents of ink recycling, ink recovery, and a returning operation by the ink recycling unit 15 are the same as those described earlier.

Figure 9:
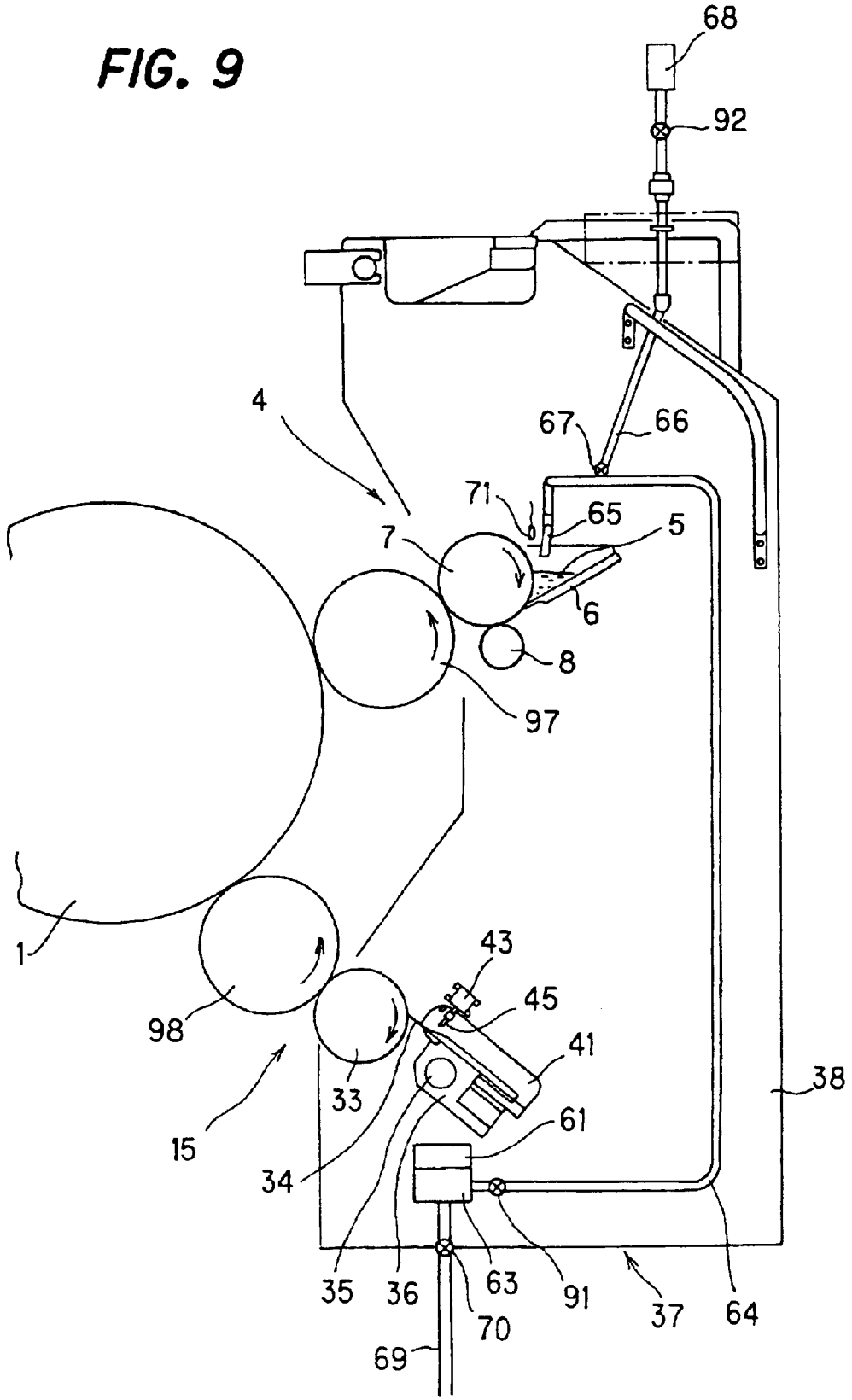
FIG. 9 is a schematic side view of an intaglio printing press according to yet another embodiment.
Figure 10:
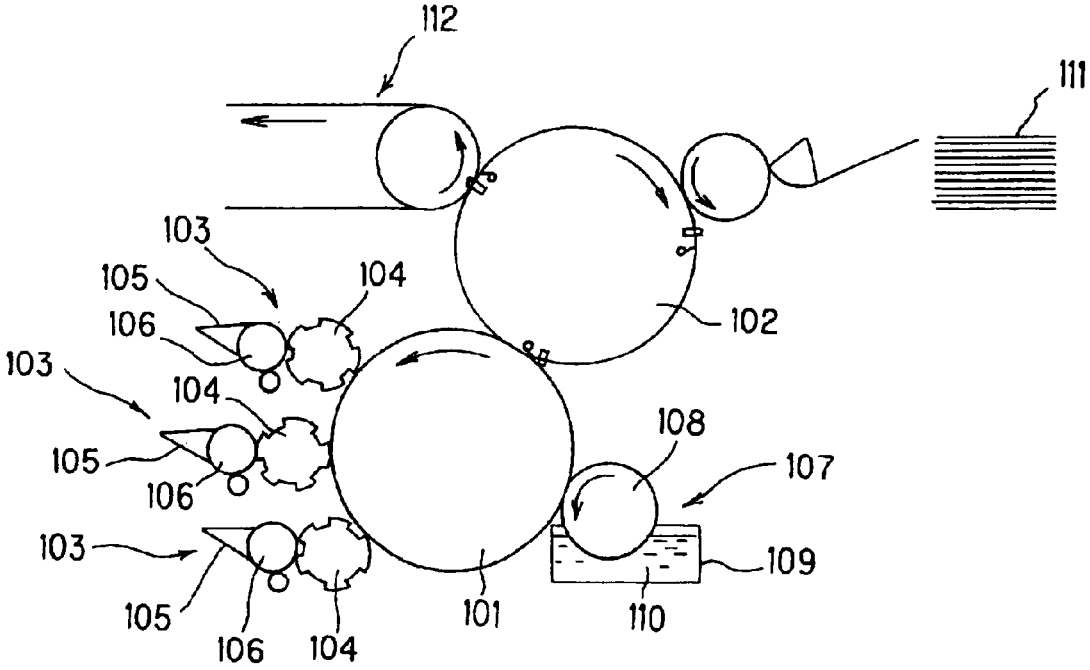
FIG. 10 PRIOR ART
FIG. 10 is a schematic side view of an example of a conventional intaglio printing press.

FIG. 9 shows yet another embodiment of the present invention.

This embodiment which adopts the present invention is an intaglio printing press for single color printing. Specifically, provided is one inking unit 4 as well as one ink supply unit 68 that supplies ink to the inking unit 4 through a pump 92. Further, there is one recycling pipe 64 which returns the recovered ink to the inking unit 4 through a switch valve 91. Both of the form roller 97 which transfers the ink from the inking unit 4 to an intaglio plate cylinder 1, and a pre-wiping roll 98 which removes the surplus ink from the intaglio plate cylinder 1 have no patterned portions. The rest of the configuration of an ink recycling unit 15 is the same as those described earlier.

The present invention is not limited to the foregoing embodiments, and may be carried out by being variously changed. For example, a direction of ink recovery is not limited to the vertical direction to the scraping blade 34. Alternatively, the ink may be recovered at the rear of the scraping blade 34. The number of pipes for returning the ink may be one when one of the inking units 4 and 81 where the ink is returned is decided. Recovery of plural kinds of ink may be dealt with by providing a plurality of ink recycling units 15.

In the ink recycling unit 15 according to the foregoing embodiments, the scraping blade 34 is provided in the support member 36 on the axis 35. Therefore, when inspecting and cleaning the ink recycling unit 15 and the ink transfer roller 33, the scraping blade 34 is rotated together with the support member 36 around the axis 35, thus enabling the scraping roller 34 to be evacuated from the ink transfer roller 33.

What is claimed is:

1. An intaglio printing press, comprising:

an intaglio plate cylinder supported rotatably;

inking units which supply ink to the intaglio plate cylinder, each of the inking units having an ink supplying pattern roller in contact with the intaglio plate cylinder, and each of the ink supplying pattern rollers having different supply patterned portions;

an ink removing unit which removes surplus ink of the ink supplied to the intaglio plate cylinder;

an ink recycling unit provided upstream of the ink removing unit with respect to a rotation direction of the intaglio plate cylinder and downstream of the inking unit, and adapted to remove ink before the ink is removed by the ink removing unit and return the removed ink to the inking unit, the ink recycling unit including precedence ink removing means which removes the ink from the intaglio plate cylinder, and ink returning means which returns the ink removed by the precedence ink removing means to the inking unit, the precedence ink means including a pre-wiping pattern roller in contact with the intaglio plate cylinder to transfer desired ink on the intaglio plate cylinder.

2. The intaglio printing press according to claim 1, wherein the pre-wiping pattern roller has at least one convexly patterned region corresponding to the area where the desired ink is applied.

3. The intaglio printing press according to claim 1, wherein the ink returning means includes at least one pipe connected between the precedence ink removal means and the inking unit, and a pump which supplies the ink to the inking unit through the pipe.

4. The intaglio printing press according to claim 3, further comprising:

ink amount detecting means which detects an amount of the ink stored in the inking unit to control the pump in accordance with a detected result by the ink amount detecting means.

5. The intaglio printing press according to claim 3, further comprising:

ink supply means which supplies new ink to the inking unit.

6. The intaglio printing press according to claim 1, wherein the precedence ink removing means includes an ink transfer roller which transfers the ink on the pre-wiping pattern roller, and ink scraping means which scrapes the ink on the ink transfer roller.

7. The intaglio printing press according to claim 6, further comprising:

a recovery blade supported to be movable and discharges the ink on the ink scraping means; and a recovery box which recovers the ink discharged by the recovery blade.

8. The intaglio printing press according to claim 7, wherein the recovery blade is adapted to reciprocate substantially along a direction of an axis of the ink transfer roller, across a surface of the scraping means.

9. The intaglio printing press according to claim 6, further comprising:

heating means which heats the scraping means.

10. The intaglio printing press according to claim 1, wherein the precedence ink removing means includes:

an ink transfer roller in contact with the pre-wiping pattern roller and adapted to transfer the ink transferred to the convexly patterned region of the pre-wiping roller;

an ink scraping blade which scrapes the ink on the ink transfer roller; and a recovery blade which recovers the ink on the scraping blade, after being scraped by the ink scraping blade, into an ink recovery box.

11. The intaglio printing press according to claim 1, wherein the precedence ink removing means has a diameter same as that of the ink supplying pattern roller.

12. An intaglio printing press, comprising:

an intaglio plate cylinder supported rotatably;

at least one inking unit which supplies ink to the intaglio plate cylinder;

an ink removing unit which removes surplus ink of the ink supplied to the intaglio plate cylinder;

an ink recycling unit provided upstream of the ink removing unit with respect to a rotation direction of the intaglio plate cylinder and downstream of the inking unit, and adapted to remove ink before the ink is removed by the ink removing unit and return the removed ink to the inking unit, the ink recycling unit including, precedence ink removing means which removes the ink from the intaglio plate cylinder, the precedence ink removing means including a pre-wiping pattern roller in contact with the intaglio plate cylinder, an ink transfer roller which transfers the ink on the pre-wiping pattern roller, and ink scraping means which scrapes the ink on the ink transfer roller, and ink returning means which returns the ink removed by the precedence ink removing means to the inking unit;

a recovery blade supported to be movable and discharges the ink on the ink scraping means;

a recovery box which recovers the ink discharged by the recovery blade; and a cutter which blocks a flow of the ink scraped by the scraping means and is provided upstream of the recovery blade in a direction of the ink flow.

13. The intaglio printing press according to claim 12, wherein the recovery blade is supported to be movable between a discharge position where the ink is discharged and a standby position, the recovery blade moves from the standby position to the discharge position when the ink flow is blocked by the cutter and recovers the ink into the recovery box, and thereafter moves from the discharge position to the standby position.

14. The intaglio printing press according to claim 13, further comprising:

scraped ink detecting means which detects the ink scraped by the scraping means and provided upstream of the cutter in a direction of the ink flow; and control means which controls the cutter and the recovery blade to be operated after a predetermined period of time which begins when the scraped ink detecting means detects the ink.

15. The intaglio printing press according to claim 14, wherein the control means controls the cutter and the recovery blade to be operated after a predetermined period of time after an ink recovery operation by the cutter and the recovery blade is completed.

16. An intaglio printing press, comprising:

an intaglio plate cylinder supported rotatably;

at least one inking unit which supplies ink to the intaglio plate cylinder;

an ink removing unit which removes surplus ink of the ink supplied to the intaglio plate cylinder; and an ink recycling unit provided upstream of the ink removing unit with respect to a rotation direction of the intaglio plate cylinder and downstream of the inking unit, and adapted to remove ink before the ink is removed by the ink removing unit and return the removed ink to the inking unit, the ink recycling unit including, precedence ink removing means which removes the ink from the intaglio plate cylinder, and ink returning means which returns the ink removed by the precedence ink removing means to the inking unit, wherein the inking units have a plurality of ink supplying pattern rollers in contact with the intaglio plate cylinder and have different supply patterned portions, respectively, the precedence ink removing means has a pre-wiping pattern roller in contact with the intaglio plate cylinder, and the pre-wiping pattern roller has at least one recovery patterned portion that is approximately the same as the supplying patterned portion of one of the ink supplying pattern rollers among the plurality of the ink supplying pattern rollers.

17. The intaglio printing press according to claim 16, wherein each of the patterned portions are formed on the plurality of the ink supplying pattern rollers in order to prevent the ink transferred from the respective patterned portions from overlapping on the intaglio plate cylinder, and the pre-wiping pattern roller recovers only the ink supplied on the intaglio plate cylinder only by one of the ink supplying pattern rollers among the plurality of ink supplying pattern rollers.

18. The intaglio printing press according to claim 16, wherein each of the patterned portions are formed on the plurality of the ink supplying pattern rollers in order to prevent the ink transferred from the respective patterned portions from overlapping on the intaglio plate cylinder, and the pre-wiping pattern roller recovers only the ink supplied on the intaglio plate cylinder only by one of the ink supplying pattern rollers among the plurality of ink supplying pattern rollers.

* * * * *